US007808401B1

(12) United States Patent
Schwartz et al.

(10) Patent No.: US 7,808,401 B1
(45) Date of Patent: Oct. 5, 2010

(54) LIGHT EMITTERS FOR OPTICAL TRAFFIC CONTROL SYSTEMS

(75) Inventors: Mark Schwartz, River Falls, WI (US); Charles Meyer, River Falls, WI (US)

(73) Assignee: Global Traffic Technologies, LLC, St. Paul, MN (US)

( * ) Notice: Subject to any disclaimer, the term of this patent is extended or adjusted under 35 U.S.C. 154(b) by 279 days.

(21) Appl. No.: 12/139,959

(22) Filed: Jun. 16, 2008

Related U.S. Application Data

(60) Provisional application No. 61/020,609, filed on Jan. 11, 2008.

(51) Int. Cl.
*G08G 1/07* (2006.01)

(52) U.S. Cl. ..... 340/906; 340/902; 340/903; 340/904; 340/905; 340/907; 340/916; 340/924; 340/994; 340/995.17; 398/103; 398/106; 398/115; 398/118; 398/151; 701/117; 701/201; 701/202; 701/207; 701/208

(58) Field of Classification Search ..... 340/902–907, 340/926, 924, 994, 995.17; 398/103, 106, 398/115, 118, 151; 701/117, 201, 202, 207, 701/208

See application file for complete search history.

(56) References Cited

U.S. PATENT DOCUMENTS

| | | | | |
|---|---|---|---|---|
| 5,014,052 | A * | 5/1991 | Obeck | 340/906 |
| 5,187,476 | A * | 2/1993 | Hamer | 340/906 |
| 6,064,319 | A * | 5/2000 | Matta | 340/917 |
| 6,326,903 | B1 * | 12/2001 | Gross et al. | 340/988 |
| 7,429,917 | B2 | 9/2008 | Fredericks et al. | 340/464 |
| 2006/0273926 | A1 | 12/2006 | Schwartz | 340/907 |

* cited by examiner

*Primary Examiner*—Tai T Nguyen
(74) *Attorney, Agent, or Firm*—Crawford Maunu PLLC

(57) ABSTRACT

Various approaches for activating a traffic control preemption system. The traffic control preemption system has a receiver with a photodetector and circuitry that produces a number of electrical pulses in response to each detected light pulse. For each detected light pulse the number of electrical pulses represents a level of radiant power of the light pulse. A threshold number of electrical pulses and an activation frequency at which the threshold number of electrical pulses is repeated activates preemption. Control circuitry is coupled to a light emitter and controls the light emitter to emit bursts of light pulses. Each burst includes at least two light pulses and the control circuitry controls the frequency of light pulses in each burst and the frequency of the bursts to cause the receiver to produce at least the threshold number of electrical pulses at the activation frequency and activate the preemption.

27 Claims, 11 Drawing Sheets

LIGHT EMITTERS FOR OPTICAL TRAFFIC CONTROL SYSTEMS

RELATED PATENT DOCUMENTS

This patent document claims the benefit, under 35 U.S.C. §119(e), of U.S. Provisional Patent Application No. 61/020,609 filed Jan. 11, 2008 and entitled: "PULSED EMITTER FOR TRAFFIC PRIORITY CONTROL SYSTEMS," which is fully incorporated herein by reference.

FIELD OF THE INVENTION

The present invention is generally directed to systems and methods that allow traffic signals to be controlled from an authorized vehicle or portable unit.

BACKGROUND

Traffic signals have long been used to regulate the flow of traffic at intersections. Generally, traffic signals have relied on timers or vehicle sensors to determine when to change traffic signal lights, thereby signaling alternating directions of traffic to stop, and others to proceed.

Emergency vehicles, such as police cars, fire trucks and ambulances, generally have the right to cross an intersection against a traffic signal. Emergency vehicles have in the past typically depended on horns, sirens and flashing lights to alert other drivers approaching the intersection that an emergency vehicle intends to cross the intersection. However, due to hearing impairment, air conditioning, audio systems and other distractions, often the driver of a vehicle approaching an intersection will not be aware of a warning being emitted by an approaching emergency vehicle.

Traffic control preemption systems assist authorized vehicles (police, fire and other public safety or transit vehicles) through signalized intersections by making a preemption request to the intersection controller. The controller will respond to the request from the vehicle by changing the intersection lights to green in the direction of the approaching vehicle. This system improves the response time of public safety personnel, while reducing dangerous situations at intersections when an emergency vehicle is trying to cross on a red light. In addition, speed and schedule efficiency can be improved for transit vehicles.

There are presently a number of known traffic control preemption systems that have equipment installed at certain traffic signals and on authorized vehicles. One such system in use today is the OPTICOM® system. This system utilizes a high power strobe tube (emitter), which is located in or on the vehicle, that generates light pulses at a predetermined rate, typically 10 Hz or 14 Hz. A receiver, which includes a photodetector and associated electronics, is typically mounted on the mast arm located at the intersection and produces a series of voltage pulses, the number of which are proportional to the intensity of light pulse received from the emitter. The emitter generates sufficient radiant power to be detected from over 2500 feet away. The conventional strobe tube emitter generates broad spectrum light. However, an optical filter is used on the detector to restrict its sensitivity to light only in the near infrared spectrum. This minimizes interference from other sources of light.

SUMMARY

The various embodiments of the invention provide various approaches for activating a traffic control preemption system.

The traffic control preemption system has a receiver with a photodetector and circuitry that produces a number of electrical pulses in response to each detected light pulse. For each detected light pulse the number of electrical pulses represents a level of radiant power of the light pulse. A threshold number of electrical pulses and an activation frequency at which the threshold number of electrical pulses is repeated activates preemption. In one embodiment, control circuitry is coupled to a light emitter and controls the light emitter to emit bursts of light pulses. Each burst includes at least two light pulses, and the control circuitry controls the frequency of light pulses in each burst and the frequency of the bursts to cause the receiver to produce at least the threshold number of electrical pulses at the activation frequency and activate the preemption.

DETAILED DESCRIPTION

The various embodiments of the invention provide a new emitter for use with existing traffic control preemption systems The new emitter uses periodic bursts of multiple pulses rather than periodic single pulses to activate the detector at the controlled intersection. It has been discovered that the bursts of pulses produce the same functional effect on the detector as does a single pulse, and by using a burst of pulses rather than a single pulse the power requirements of the emitter can be significantly reduced. In addition, the burst pulse approach may be implemented in a variety of different types of emitters, which are described below. Generally, the burst pulse approach supports newer LED-based implementations as well as adaptations of traditional light sources, for example, light bars having xenon or halogen lamps, found on emergency vehicles. The reduction in power consumption that may be achieved with various embodiments of the invention relative to prior strobe emitters (e.g., an Opticom strobe emitter) may be as much as 90% or more without loss of effective range. Those skilled in the art will recognize that certain embodiments are adaptable as may be beneficial for future traffic control preemption systems.

Figure 1:
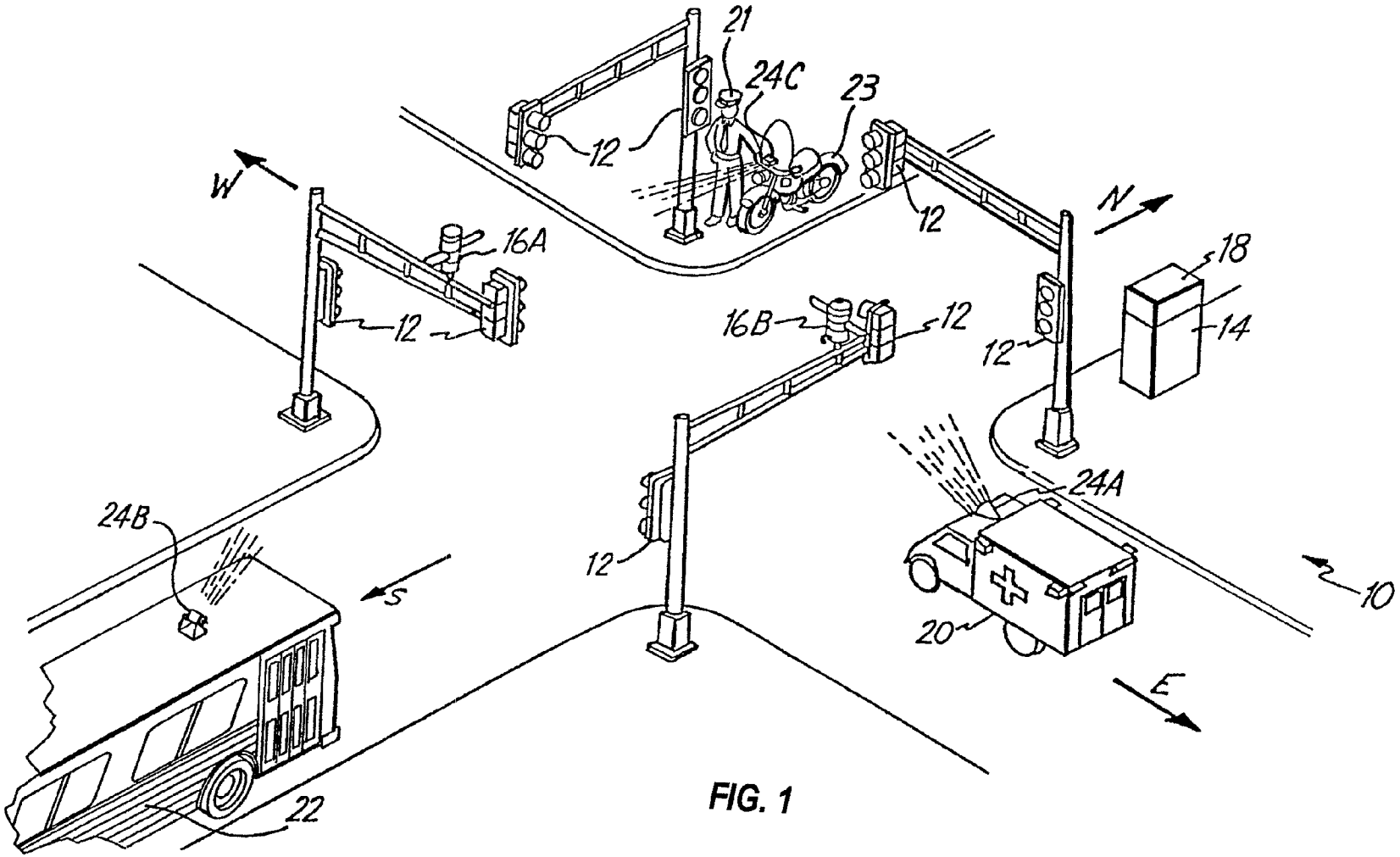
FIG. 1 is an illustration of an intersection having traffic signal lights and a traffic control preemption system.

FIG. 1 is an illustration of a typical intersection 10 having traffic signal lights 12. The equipment at the intersection illustrates the environment in which embodiments of the present invention may be used. A traffic signal controller 14 sequences the traffic signal lights 12 to allow traffic to proceed alternately through the intersection 10. In one embodiment, the intersection 10 may be equipped with a traffic control preemption system such as the OPTICOM® Priority Control System. In addition to the general description provided below, U.S. Pat. No. 5,172,113 to Hamer, which is incorporated herein by reference, provides further operational details of the example traffic control preemption system shown in FIG. 1.

The traffic control preemption system shown in FIG. 1 includes detector assemblies 16A and 16B, optical emitters 24A, 24B and 24C and a phase selector 18. The detector assemblies 16A and 16B are stationed to detect light pulses emitted by authorized vehicles approaching the intersection 10. The detector assemblies 16A and 16B communicate with the phase selector 18, which is typically located in the same cabinet as the traffic controller 14.

In FIG. 1, an ambulance 20 and a bus 22 are approaching the intersection 10. The optical emitter 24A is mounted on the ambulance 20 and the optical emitter 24B is mounted on the bus 22. The optical emitters 24A and 24B each transmit a stream of light pulses that are received by detector assemblies 16A and 16B. The detector assemblies 16A and 16B send output signals to the phase selector 18. The phase selector 18 processes the output signals from the detector assemblies 16A and 16B to validate that the light pulses are at the correct activation frequency and intensity (e.g., 10 or 14 Hz), and if the correct frequency and intensity are observed the phase selector generates a preemption request to the traffic signal controller 14 to preempt a normal traffic signal sequence.

FIG. 1 also shows an authorized person 21 operating a portable optical emitter 24C, which is shown mounted to a motorcycle 23. In one embodiment, the emitter 24C is used to set the detection range of the optical traffic preemption system. In another embodiment, the emitter 24C is used by the person 21 to affect the traffic signal lights 12 in situations that require manual control of the intersection 10.

In one configuration, the traffic preemption system may employ a preemption priority level. For example, the ambulance 20 would be given priority over the bus 22 since a human life may be at stake. Accordingly, the ambulance 20 would transmit a preemption request with a predetermined repetition rate indicative of a high priority, such as 14 pulses per second, while the bus 20 would transmit a preemption request with a predetermined repetition rate indicative of a low priority, such as 10 pulses per second. The phase selector would discriminate between the low and high priority signals and request the traffic signal controller 14 to cause the traffic signal lights 12 controlling the ambulance's approach to the intersection to remain or become green and the traffic signal lights 12 controlling the bus's approach to the intersection to remain or become red.

The phase selector alternately issues preemption requests to and withdraws preemption requests from the traffic signal controller, and the traffic signal controller determines whether the preemption requests can be granted. The traffic signal controller may also receive preemption requests originating from other sources, such as a nearby railroad crossing, in which case the traffic signal controller may determine that the preemption request from the other source be granted before the preemption request from the phase selector.

The various embodiments of the invention provide a variety of options for remotely controlling traffic signals. In one embodiment, an authorized person (such as person 21 in FIG. 1) can remotely control a traffic intersection during situations requiring manual traffic control, such as funerals, parades or athletic events, by using the emitter described herein. In this embodiment the emitter has a keypad, joystick, toggle switch or other input device which the authorized person uses to select traffic signal phases. The emitter, in response to the information entered through the input device, transmits a stream of light pulses which include an operation code representing the selected traffic signal phases. In response to the operation code, the phase selector will issue preemption requests to the traffic signal controller, which will probably assume the desired phases.

In another scenario, the emitter may be used by field maintenance workers to set operating parameters of the traffic preemption system, such as the effective range. For example, the maintenance worker positions the emitter at the desired range and transmits a range setting code. The phase selector then determines the amplitude of the optical signal and uses this amplitude as a threshold for future transmissions, except transmissions having a range setting code.

The existing system described above has been used for many years and works well, however the conventional strobe tube emitter requires significant power to operate (30 W) and much of the power is used to generate light in bandwidths that are not used by the photo detector. The conventional strobe tube uses a xenon lamp and its high voltage power supply are large and also difficult to fabricate in low profile form factors. Typically, strobe emitters are mounted on the roof of the emergency vehicle due to their size. However, roof mounting has the potential of interfering with or limiting the locations of other equipment on the emergency vehicle, and may be subject to damage. Typical strobe emitters also are quite visible due to their size, thereby undesirably drawing attention to unmarked emergency vehicles.

The burst mode employed in the various embodiments of the invention may be better understood by way of observing the behavior of the detectors 16A and 16B relative to different pulses of light. The optical detector circuitry used in OPTICOM® traffic preemption systems at the intersection creates a series of pulses proportional to the intensity of the near infrared spectrum incident light pulses generated by the emitter. This is shown and described in detail in U.S. Pat. No. 5,187,476 OPTICAL TRAFFIC PREEMPTION DETECTOR CIRCUITRY by Steven Hamer, which is incorporated herein by reference. The detector circuitry utilizes a rise time filter to isolate the step current pulse generated by the photo detector in response to the light pulse. The current pulse is converted to a voltage pulse and routed through a band-pass filter (BPF) which works over a range with a center frequency of about 6.5 KHz. The output signal of the BPF is a 6.5 KHz decaying sinusoidal waveform with an amplitude and duration that is proportional to the amplitude the input pulse. The width of the input pulse can also change the number of voltage pulses that are output, however there are diminishing returns as the pulse width is increased because the 6.5 kHz content of the pulse does not increase proportionally to the pulse width, and a pulse width wider than about 50 μs has essentially no additionally 6.5 kHz content.

Figure 2:
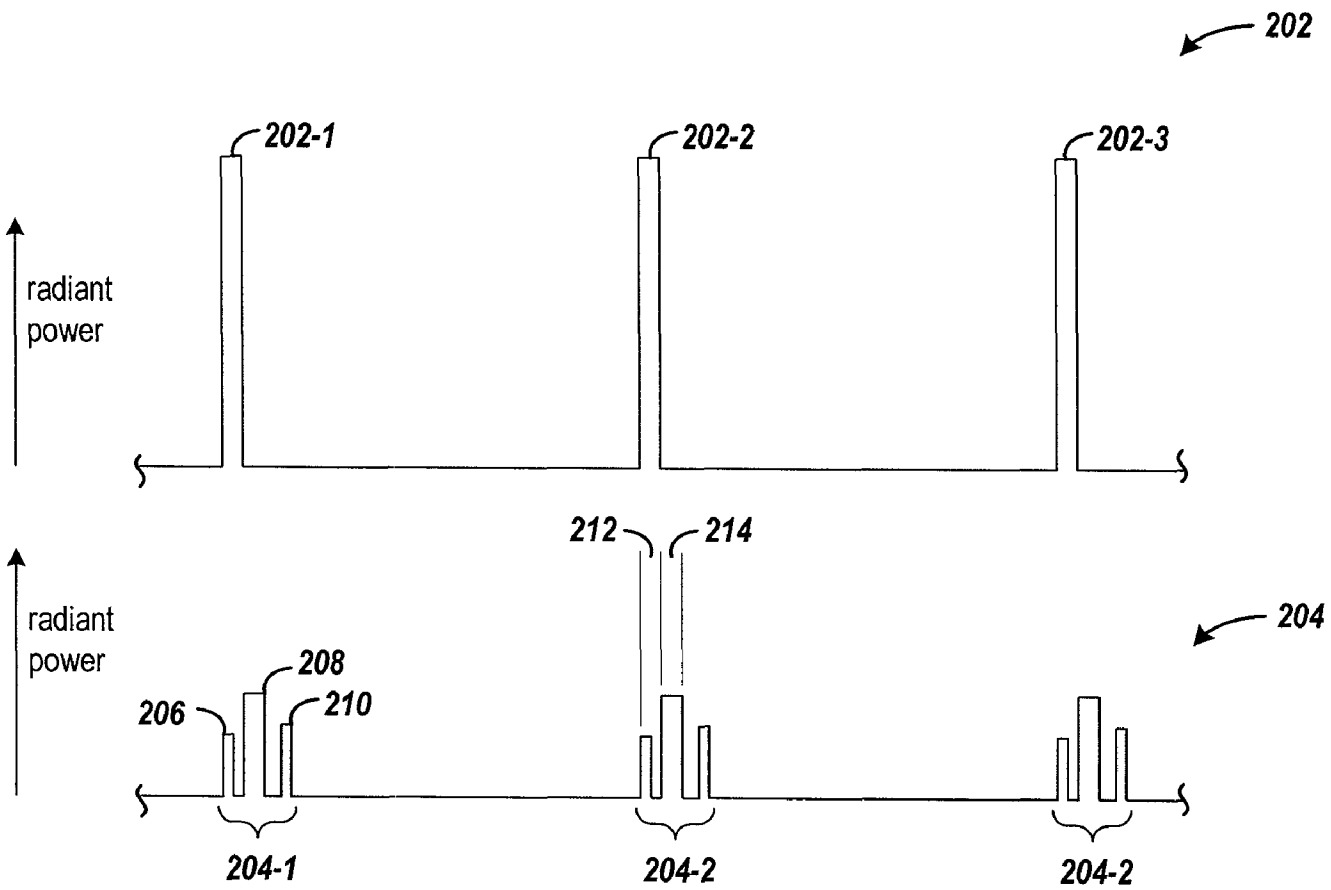
FIG. 2 shows a comparison of three, single, higher radiant power light pulses as compared to three bursts of lower power pulses.
Figure 3:
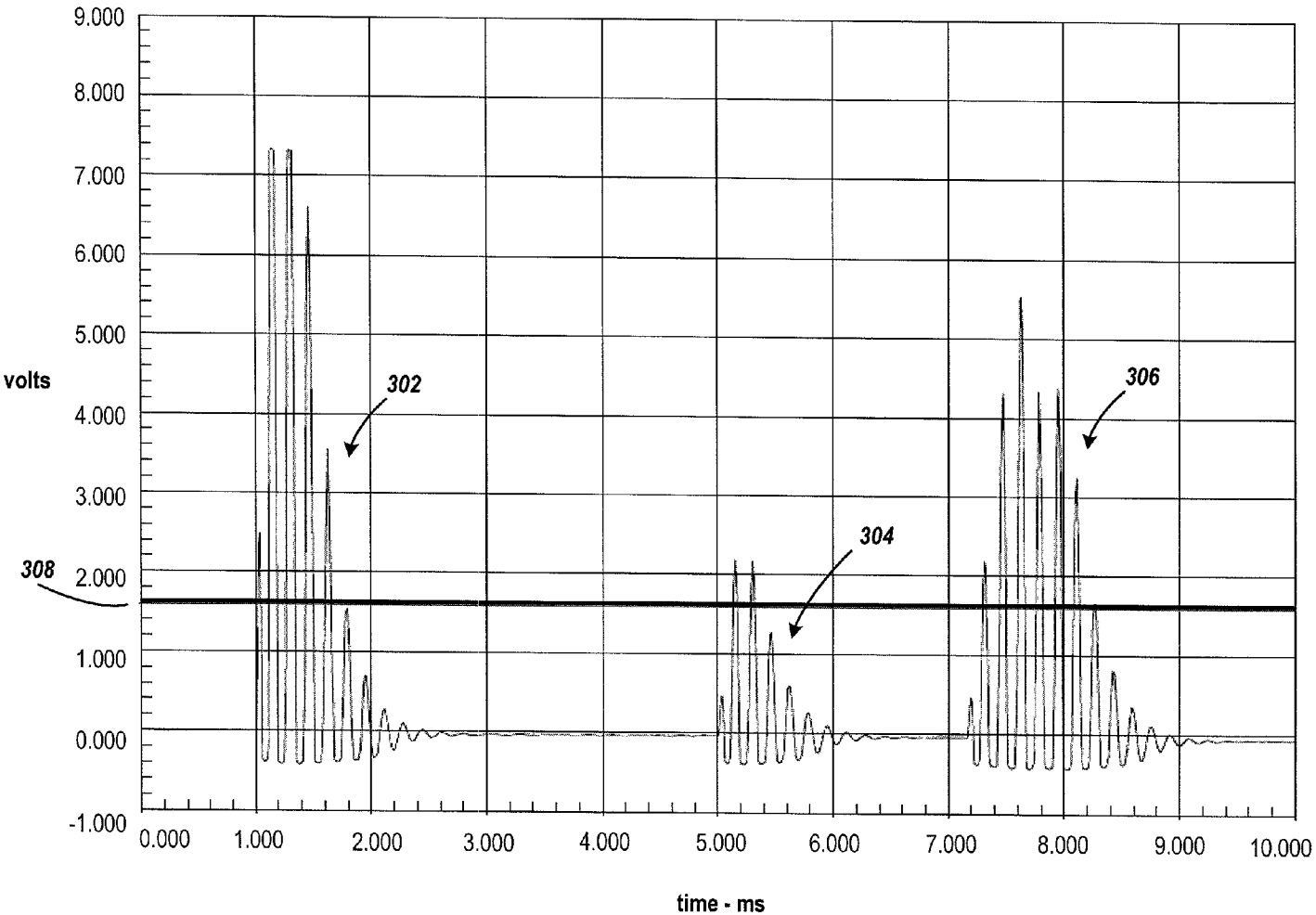
FIG. 3 shows detector output for a single, high-power pulse, a single low-power pulse, and a burst of pulses.

For the light emitter, FIG. 2 shows a comparison of three, single, higher radiant power light pulses as compared to three bursts of lower power pulses, and for the detector FIG. 3 shows detector output for a single, high-power pulse, a single low-power pulse, and a burst of pulses. In FIG. 2 for a corresponding time period and with the same scale for radiant power, single light pulses 202 are emitted at a relatively high level of radiant power, and bursts of light pulses 204 emitted at a relatively lower level of radiant power. Note that in both cases it is assumed that the light pulses are of sufficient radiant power to cause the detector to output electrical pulses that are recognized by the phase selector.

In the example comparison, the light pulses 202 are emitted at radiant power level, which corresponds to the amplitude of the pulse, and at a frequency of 10 Hz or 14 Hz to activate the phase selector. Light pulses 204 show an example of the burst mode employed in various embodiments of the invention. A burst of pulses at a relatively lower radiant power pulses is emitted instead of the higher power single pulse. For example, burst 204-1 includes three pulses 206, 208, and 210, which cause the same response from the detectors 16A and 16B as would the single higher power pulse 202-1. The radiant power level of each pulse 206, 208, and 210 in the burst is less than the radiant power level, A1 of pulse 202-1.

The number of pulses in a burst, as well as the amplitude and pulse width of those pulses may vary depending on the desired pulse detection and operating characteristics of the intended detector.

FIG. 3 shows the output from a Simulation Program with Integrated Circuit Emphasis (SPICE) simulation of an example detector for a single, high-power light pulse, a single lower-power light pulse, and a burst of lower-power light pulses. The example detector is an Opticom Model 711 detector. In FIG. 3, the first pulse train 302 is generated by the detector in response to a single, high power pulse (e.g., 100 nW) for 40 μs. The incident energy for this pulse can be calculated as 100 nW×40 uS=4E-12 joules. The second pulse train 304 is generated in response to a single, low power pulse (e.g., 20 nW) for 40 μs. The incident energy, calculated as described above, is 0.8E-12 joules. It may be observed that the low power pulse is ⅕ the power and energy level of the high power pulse. The third pulse train 306 is generated by a burst of 4 low power pulses (e.g., 20 nW), spaced 160 μs as apart.

In an example implementation, the trip level detected by the phase selector 18 may be 1.6 volts and the number of peaks above the trip line 308 is indicative of the apparent light pulse intensity or radiant power level at the detector. The trip line is a threshold voltage level to be exceeded for the phase selector to recognize the output voltage pulse. The first pulse stream 302 has 5 peaks above the trip line, the second pulse stream 304 has 2 peaks above the trip line and the third pulse stream 306 has 6 peaks above the trip line. Thus, the first and third pulse streams 302 and 306 are observed by the phase selector as having the same intensity.

It will be appreciated that there is a threshold number of voltage pulses above the trip line 308 that activates the phase selector to issue a preemption request to preempt the normal cycling of the traffic signal. Thus, the characteristics of each burst of optical pulses (number, width, interval) cause the detector to generate a series of pulses that is proportional to an equivalent single optical pulse of a much greater radiant power, such that at least the threshold number of electrical pulses is provided to activate the phase selector preemption request.

In this example the total incident energy of the burst of 4 low power pulses can be computed as 80% of the total energy of the single high power pulse. However it should be noted that energy pulses longer than approximately 50 μs do not appreciably increase the number of pulses generated by the detector. Therefore the only way increase the detector output for a single pulse is to increase the incident power. This means that emitter light source power output for a single pulse would need to be approximately 5 times higher for a single pulse than for a series of 5 low power pulses to generate an equivalent output from the detector. For example, for each LED in the light source used to generate the burst of 5 low power pulses and thereby cause the detector to output the pulse train 306, 5 LEDs would be required to emit a suitable single light pulse for causing the detector to output the pulse train 302.

The burst mode embodiments utilize LED-generated light pulses at some approximate multiple of the BPF center frequency (e.g., approximately 6.5 kHz) to increase the apparent intensity of the LED emitter. For example, a first pulse is 40 μs wide followed 1 time period later (140 μs) by another 40 μs wide pulse, which is followed by another 40 μs wide pulse located 2 time periods after the initial pulse (280 μs) etc. Alternatively, the first pulse is 40 μs wide, which is followed 2 time periods later (280 μs) by another 40 μs wide pulse located 3 time periods after the initial pulse 420 μs etc. The pulse width can also be modified in both examples. The effect of pulses received after the initial pulse is additive and generates additional output pulses at the BPF center frequency which increases the apparent intensity of the incident pulses. By generating 8 or 9 pulses the apparent intensity can be greatly increased to give the emitter more range than the conventional strobe tube emitter while using far less power. Alternatively, by only using 2 or 3 pulses the apparent intensity can be increased sufficiently to match the intensity of the conventional strobe tube emitter. The pulse stream may also contain pulses that are out of phase with the initial pulse to provide further control (subtractive effect) of the apparent intensity output of the detector circuitry. While square wave pulses are the easiest to generate, other shapes such as a sinusoid, triangle or ramp function could be used. The desired burst is repeated at the 10 Hz or 14 Hz frequency for the traffic preemption control.

Different implementations will likely have different burst characteristics. For example, in an implementation involving LEDs, the power and number of LEDs, as well as the characteristics of the mounting location on or in a vehicle, will affect the number and characteristics of the pulses making up a burst for the desired range of operation for obtaining the desired responses from the targeted detectors. If fewer or lower powered LEDs are used, more pulses may be needed in each burst, and if more or higher powered LEDs are used each burst may require fewer pulses. Also, the pulses of a burst may not need to have the same characteristics, and it is possible for individual pulses to be skipped or absent from the burst, depending on the number and type of LEDs for a chosen implementation. Further, one or more pulses may be shifted in time to represent phase cancellation instead of reinforcement at the detector. The desired pulse characteristics are then programmed into a microcontroller to control the required system performance and range.

One benefit to using the burst mode approach is the dramatic reduction in the number of LEDs and power required to obtain a range that is equivalent to or greater than that of prior strobe tube emitters which use xenon lamps. Another advantage of this approach is that by adjusting the number of pulses, the pulse width 214, and the pulse interval 212, both additive and subtractive effects can be used to give the LED emitter radiant power characteristics that appear to the detector to mirror the radiant power of the strobe tube emitter. This is a tremendous advantage for existing installations because the preemption range trip points can be identical for newer LED emitters and the prior strobe emitters. Generating pulses in this manner will also allow creating of emitters with customized characteristics on a common hardware platform, for example short range emitters for mass transportation purposes and very long range emitters for emergency services.

According to certain embodiments lower powered light sources are used to provide compact emitters that provide greater mounting flexibility on or in vehicles. In certain specific embodiments, multiple LED devices are used to create the preemption request signal for a traffic control preemption system. LEDs have an advantage of emitting light in a very narrow band of wavelengths, which can be matched to the characteristics of the detector for maximum efficiency. Although any wavelength of light may be used by suitable selection of LEDs and detector or detector filter sensitivities, infrared LEDs may be preferred for many applications. This is because the use of infrared light avoids interference from other light sources. Also, there is a practical advantage to infrared LEDs because a large number of installed traffic control systems, for example, the OPTICOM® systems, use an infrared filter over their detectors. Thus, the use of the corresponding wavelength of LED emitters leads to greater compatibility without requiring modifications to existing systems. It will be appreciated that other implementations may find a combination of infrared and visible light LEDs to be useful in the emitter, with both the infrared and visible light LEDs being operated in the burst mode. Furthermore, because the power consumed by LEDs is much lower than the conventional high-powered strobes used in conventional preemption request emitters, the electrical load on vehicle alternators is reduced, as is the unwanted production of heat. The previously described burst mode permits the low radiant power output LEDs to achieve sufficient distance or range of performance for activation of traffic preemption as those achieved with conventional xenon strobes with significant power savings. For example, a conventional Opticom strobe emitter requires approximately 30 W of power while an LED emitter operating in burst most and providing similar effective range characteristics requires less than 3 W. Thus, various embodiments of the invention provide a 90% reduction in power consumption.

Figure 4:
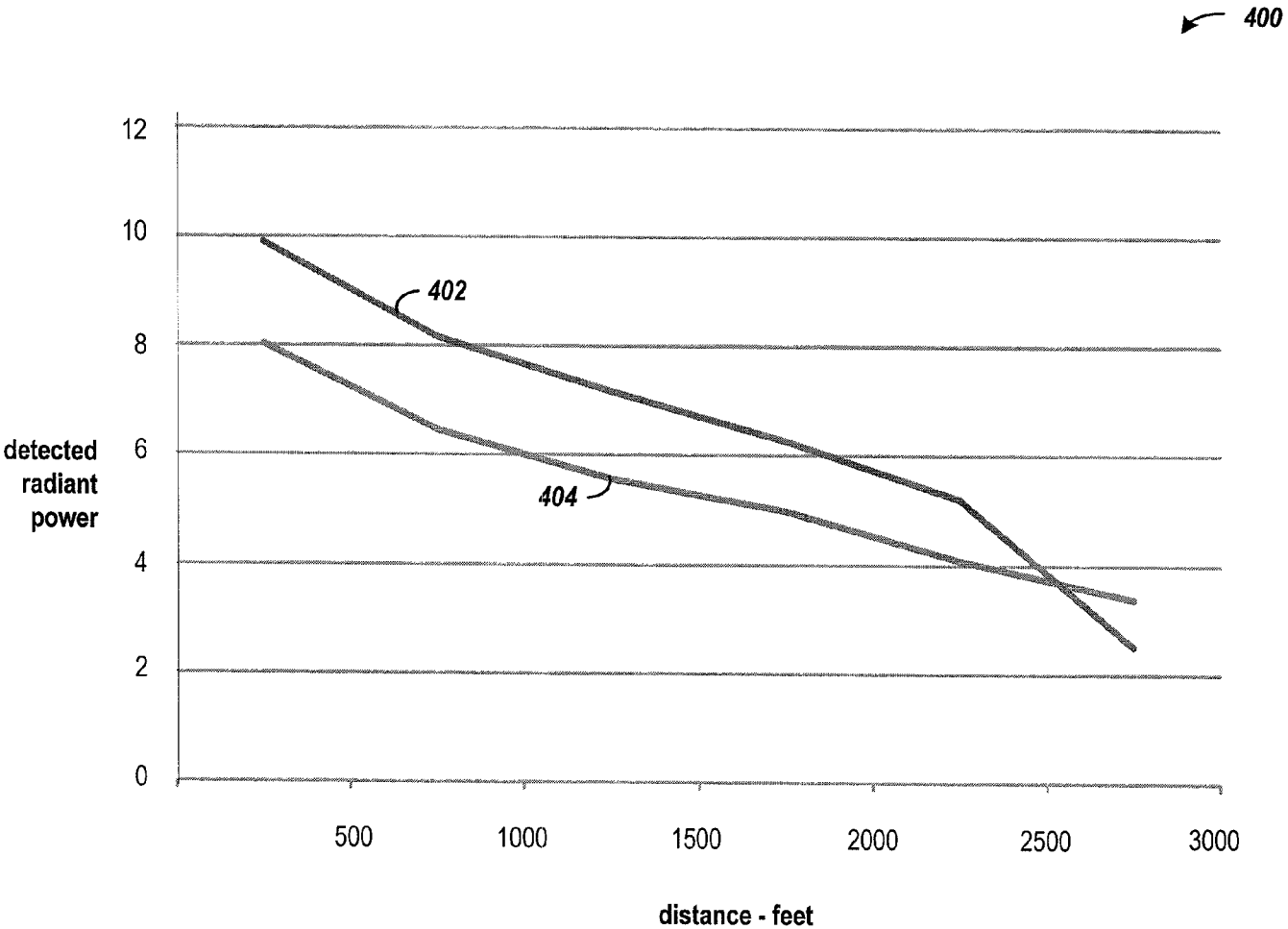
FIG. 4 is a graph that shows the detected radiant power levels as received from an emitter that uses the burst mode described herein and as received from a single pulse emitter.

FIG. 4 is a graph that shows the detected radiant power levels as received from an emitter that uses the burst mode described herein and as received from a single pulse emitter. Plot line 402 shows the detected radiant power level for an emitter operating with the burst pulse mode, and plot line 404 shows the detected radiant power level for an emitter using single pulses. The horizontal axis represents distance in feet, and the vertical access represents the detected relative radiant power levels.

These example plots are based on actual measurements made with a detector (OPTICOM 721) connected to phase selector (OPTICOM 754), both of which are commercially available. The emitter operating in single pulse mode is the commercially available OPTICOM 792 emitter. The burst mode emitter is constructed in accordance with one or more embodiments of the invention as described herein. In particular, the example burst mode emitter is configured with 8 channels of 9 LEDs, in which the LEDs have a dispersion angle of +/−10 degrees and emit infrared light having a wavelength of 890 nm.

The plot lines 402 and 404 show that the detector perceives a greater radiant power level from the burst mode emitter than from the single pulse mode emitter over a distance of approximately 250 to 2500 feet.

Figure 5:
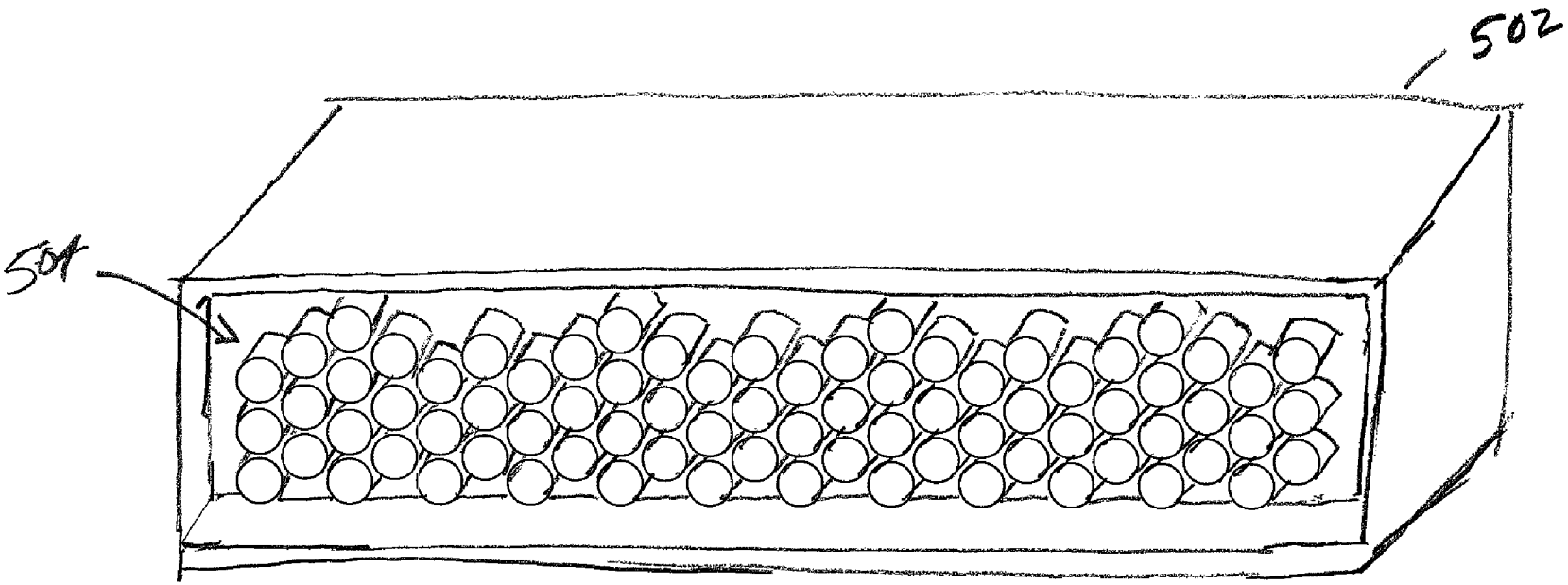
FIG. 5 shows an example LED-based light emitter in accordance with various embodiments of the invention.

FIG. 5 shows an example LED-based light emitter in accordance with various embodiments of the invention. In the example embodiment, the light emitter has a housing 502 in which a plurality of IR LEDs 504 are disposed and arranged to emit light. In an example implementation, LEDs having a peak wavelength, $\lambda_p$=890 nm, an angle of half intensity, $\phi=\pm10°$, and a power dissipation 180 mW have been found to be useful. Those skilled in the art that the characteristics of the LED will vary from application to application. In one embodiment, switching circuits, power supplies, and control circuitry are also disposed within housing 502. Alternatively, these additional components may be housed separate from the LEDs 504 and connected thereto.

The angle of dispersion of the generated IR light from the LEDs 504 is preferably controlled for optimum near and far range operation. Discrete LEDs may have plastic encapsulation with lenses formed thereon to disperse emitted light. Alternatively, individual lenses or large lenses may be fitted over the desired LEDs to provide the desired dispersion. In order to emit sufficient radiant power from a distance, some number of the LEDs are provided with lenses having a relatively narrow dispersion angle. The number and angle of view will depend on the radiant power of individual LEDs and the desired distance. In one embodiment, others of the LEDs are provided with lenses having a relatively wider dispersion angle to ensure that sufficient light is aimed upward to reach the detectors as the vehicle approaches close to controlled road. In another embodiment, the LEDs may be outfitted with lenses having the same dispersion angle that permits light to reach the detector as the vehicle approaches close to controlled road, and the LEDs may be sufficiently powered to emit pulses that would activate the detector from the desired distance. It will be appreciated that various combinations of lenses having different dispersion angles may be used to satisfy implementation requirements. The lenses provide minimal side dispersion of light to prevent unwanted side street activations. In an example implementation, LEDs having a dispersion angle of +/−10 degrees provide a reasonable approximation to the performance of a prior xenon tube emitter from Opticom for both curved and straight approaches to the controller road.

The particular dimensions of the housing and components disposed therein depend on the chosen implementation. In one embodiment, the light emitter is constructed for use as a standalone, handheld device. In such a handheld device the control circuitry and LEDs may be powered with a power source as small as a conventional nine-volt battery. In another embodiment, the emitter is constructed for mounting to various locations on a vehicle. Various locations on a vehicle to which the light emitter can be mounted include, for example, the hood area as indicated, grille area, windshield area, dashboard area, or behind the mirror or sunvisor or any other location where light from the emitter projects forward. Also, LEDs may be mounted along or around the windshield frame, either inside or outside the vehicle. It will be appreciated that depending on placement of the light emitter, such as behind a windshield that absorb IR, additional power or pulses may be needed to compensate. In yet another embodiment, the emitter is constructed as a module for mounting with other components of a light bar.

Figure 6:
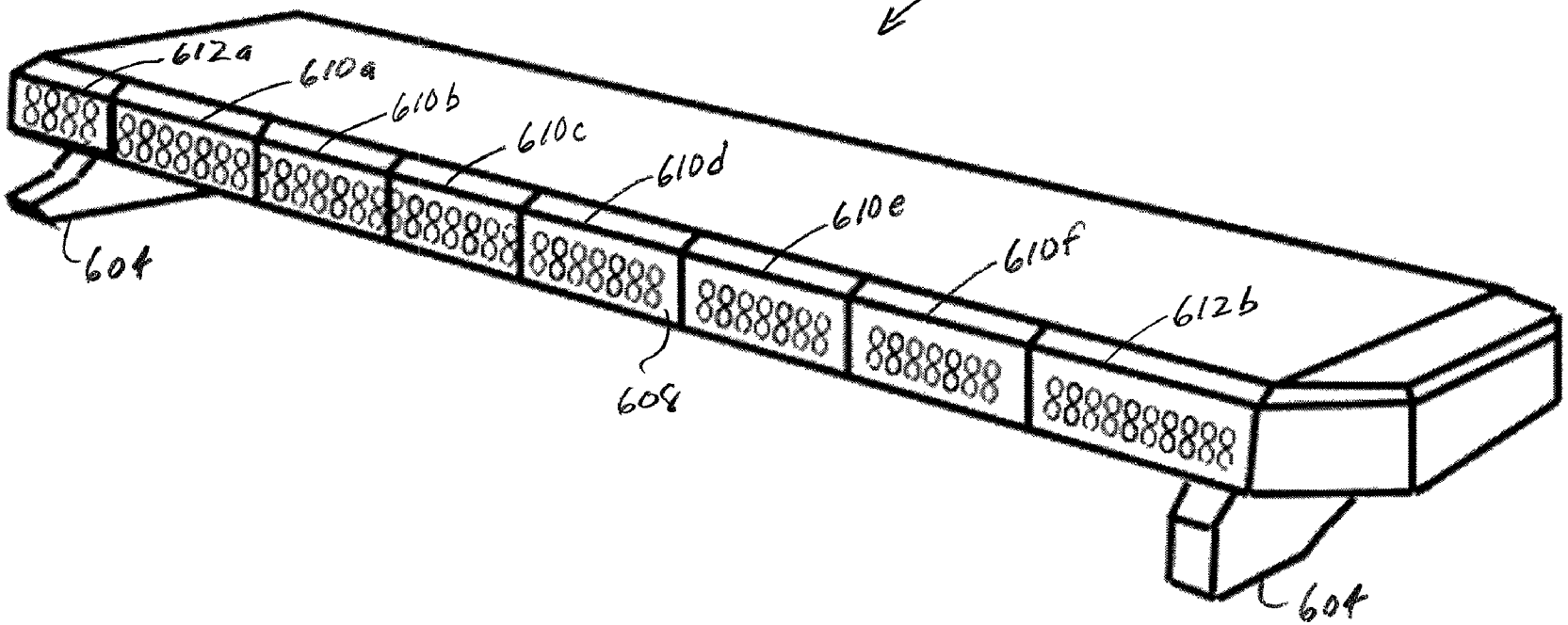
FIG. 6 shows an example embodiment of the invention in which a light bar provides bursts of light pulses for activating a traffic priority system.

FIG. 6 shows an example embodiment of the invention in which a light bar 600 provides bursts of light pulses for activating a traffic control preemption system. The light bar may be installed with one or more modular, LED-based light emitters such as that described above. Alternatively, the burst mode may implemented in a light bar that is largely composed of LEDs and selected ones of those LEDs controlled to emit burst mode light pulses. In yet another embodiment, xenon or halogen strobes in a light bar may be flashed to implement the burst mode.

Light bars are designed for mounting to the roof of an emergency vehicle and typically contain red, blue and/or white flashing lights controlled by the operator to provide a visual warning to the public. Light bars may also contain other devices such as sirens or speakers. The modern trend in light bars is for low profile designs which have less bulk and aerodynamic drag than older flasher designs.

Light bar 600 has a body 602 for mounting to the roof of a vehicle via feet 604 shown at either side, such that the array of lights is positioned on the forward face 608. A number of light emitting sections 610*a-f* are shown along forward face 608, and sections 612-*b* are shown at the sides. Light emitter sections may also be provided at the reward face (not shown). While FIG. 6 shows a certain number of light emitter sections, this is by way of example only, as the number used can be more or fewer than the example shown, or alternatively, the various light emitting devices may be placed along the light bar without the use of sections.

A large number of LED devices can be placed in a light bar without significantly changing the overall dimensions of the light bar. Preferably the highest powered LED devices would be used. Because of the efficiency of LEDs, the switching circuits and power supplies will not take up as much room as the power supplies for conventional xenon or halogen strobes. Certain ones of light emitter sections 610*a-f* may provide white light, red light, or blue light for visible warning flashing. In addition, one or more of light emitter sections 610*a-f* may have a plurality of IR LEDs for use in preemption signaling. Alternatively, IR LEDs can be placed within sections of visible light LEDs, but controlled as described above for preemption control. Further, it is possible that the traffic control IR LEDs may be used with other types of light emitters such as strobes for the visible light function of the light bar.

As mentioned above, a plurality of small strobes (e.g., xenon or halogen) can be used according to other embodiments, in place of the larger strobe in existing vehicle-mounted emitters. These smaller strobes can be activated to implement the burst mode described above. Control circuitry simultaneously flashes strobes of the light bar to provide the burst mode at a multiple of the approximately 6.5 KHz band pass frequency of the detector circuitry. Alternatively, individual strobes of the light bar can be flashed sequentially, whereby a burst consists of rapid sequential timed flashing of individual strobes in the bank, with the sequence repeated at the 10 or 14 Hz rate. As in the case of the LED embodiments, the number of flashes, their individual durations, waveshapes, and intervals can be manipulated by the control circuits to make a particular light bar operable for a desired activation range. If additional flashes are needed in a burst beyond the number of strobes in the light bar, strobes can be repeated in a burst as needed. The strobes used for burst mode should have rapid quenching so that the light falloff at the end of a pulse does not sustain and overlap the initiation of the next pulse in a burst, which would otherwise adversely affect the rise time response seen at the detector.

In another embodiment, small, low-powered strobes (e.g., gas discharge lamps such as xenon or incandescent lamps such as halogen) can also be used in the burst mode to provide a small enough physical package to mount in locations on the emergency vehicle other than the light bar. For example, It can be made to mount on the top of a dashboard, to the inside of the windshield, behind the rearview mirror, behind the sun visor or other locations. It can also be made in a standalone unit that can be used in a vehicle, or in portably, outside the vehicle. It will be appreciated that a single lamp emitter may be constructed to operate in the burst mode if implementation requirements permit. For example, a single lamp may be controlled to emit the bursts of pulses with multiple power supplies, each powering the lamp for one of the pulses in a burst. Alternatively, a single power supply that is capable of recharging at a rate sufficient to power lamp in the burst mode may be used.

Figure 7:
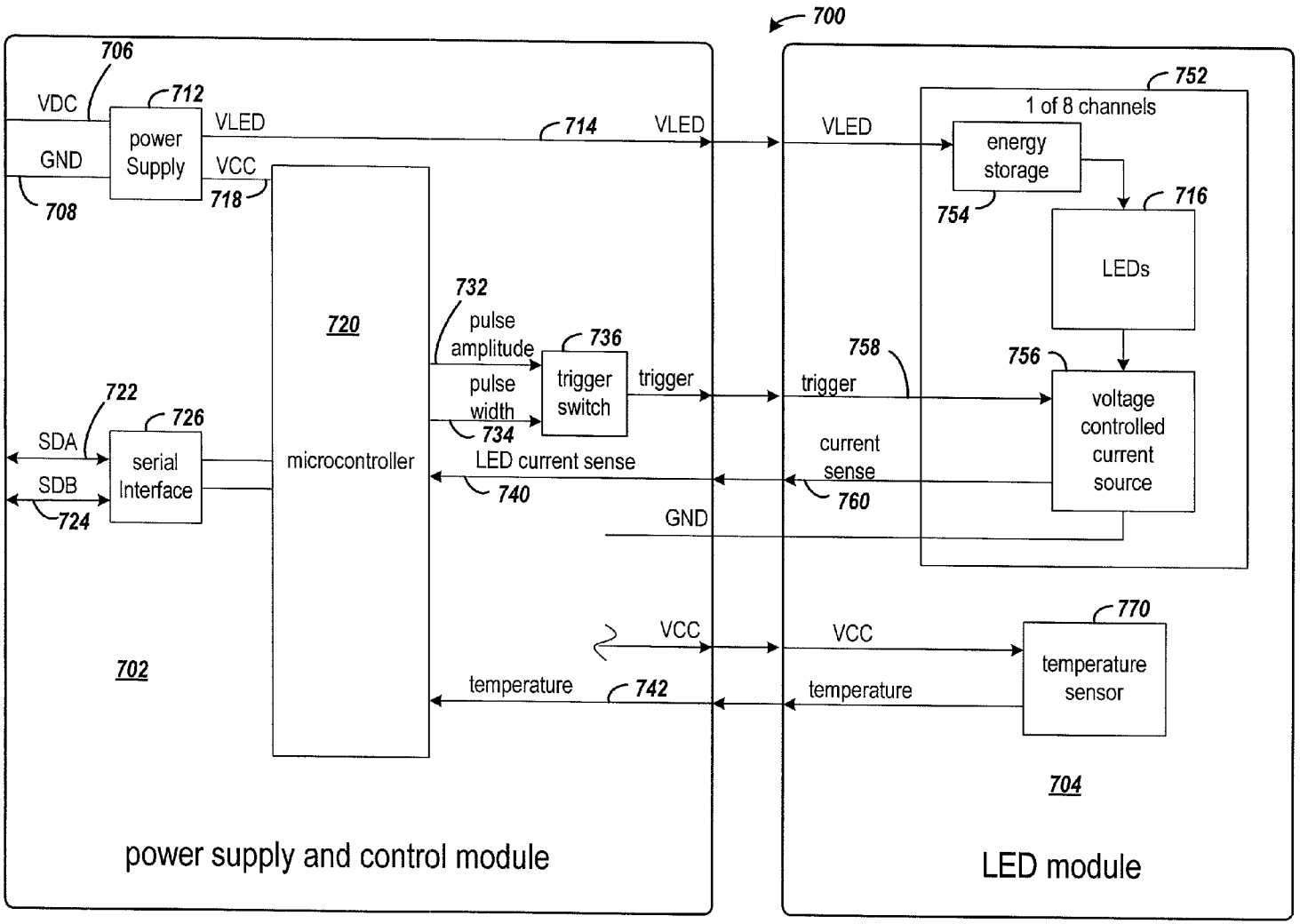
FIG. 7 is a functional block diagram of a circuit arrangement for controlling and driving a plurality of LEDs in the burst mode.

FIG. 7 is a functional block diagram of a circuit arrangement 700 for controlling and driving a plurality of LEDs in the burst mode. The power supply/control module is referenced as 702, and the LED array module is referenced as 704. Module 702 has a suitable connectors (not shown) for coupling to vehicle power 706 and ground 708, which connection can also be used by a switch (not shown) in the vehicle to turn on and off the emitter. Those skilled in the art will recognize suitable connectors and switches for different specific implementations. Vehicle DC is applied to power supply 712, which provides the voltage supply, VLED 714, for driving the LEDs 716, and also logic level voltage, VCC 718, for microcontroller 720. An example suitable power supply operates from an input voltage range of 10 VDC to 32 VDC. Note that for ease of explanation, each signal and the line carrying that signal are referred to by the same name and reference number. Serial connections 722 and 724 are also provided to serial interface 726 which also connects to microcontroller 720. The external serial interfaces SDA and SDB provide an interface to set an ID code that will be transmitted by the emitter. The serial interface can also be used to change the burst pulse characteristics and provides an interface to update the firmware code.

Microcontroller 720 is a programmed microprocessor which generates control signals for the burst mode and outputs pulse amplitude control 732 and pulse width control 734 to trigger switch 736. Microcontroller 720 also receives LED current sense and temperature signals 740 and 742 from the LED module 704. In an example implementation a microcontroller such as the PIC24 16-bit microcontroller from MICROCHIP® Technology, Inc., has been found to be useful.

Power supply and control module 702 is connected to LED array module 704 by connectors suitable for the implementation. Those skilled in the art will recognize that whether the light emitter is constructed as a single unit or as multiple modules will depend on implementation-specific form factor restrictions. In an example implementation the power supply and control module and LED modules meet the form factor restrictions of a length ≧6", a height ≧1.5", and a depth ≧2".

The LED module 704 includes multiple channels of LEDs (e.g., 8 in one implementation). Block 752 depicts one of the multiple channels. The high voltage (for example, 40 volts) VLED 714 is coupled to an energy storage element 754 which in turn is coupled to LEDs 716. In an example embodiment, the energy storage element 754 is a capacitor, e.g., 220 μF and 50 VDC. In an example implementation, the LEDs in each channel, for example, 716, are a plurality of LEDs connected in series. A greater or smaller number may be used with corresponding changes to the voltage and power supplied. The last LED in the series is coupled to a switchable voltage controlled current source 756, such as a conventional op-amp and power transistor configuration. The trigger signal 758 is applied from trigger switch 736 to the voltage controlled current source 756, and a current sense signal 760 is fed back to microcontroller 720. In an example embodiment, the trigger switch 736 is a single pole double throw (SPDT) type analog switch with a turn-on and turn-off time of less than 50 ns and a supply voltage of 3.3 V. In response to a lack of current in a defective channel, the microcontroller 720 increases the current in the remaining operational channels to compensate for the loss of radiant power in the defective channel.

A temperature sensor 770 provides the temperature signal 742, which represents the temperature conditions within the LED module, to the microcontroller 720. An example temperature sensor suitable for use with the example microcontroller 720 is the MCP9700 sensor from MICROCHIP® Technology, Inc. In response to the temperature falling below or rising above certain thresholds, the microcontroller adjusts the pulse amplitude and pulse width to compensate for the variation of LED radiant power due to operating temperature. For example, the amplitude and/or pulse width may be varied +/−20% as the temperature approaches a low of −35 C or a high of 75 C.

Figure 8A:
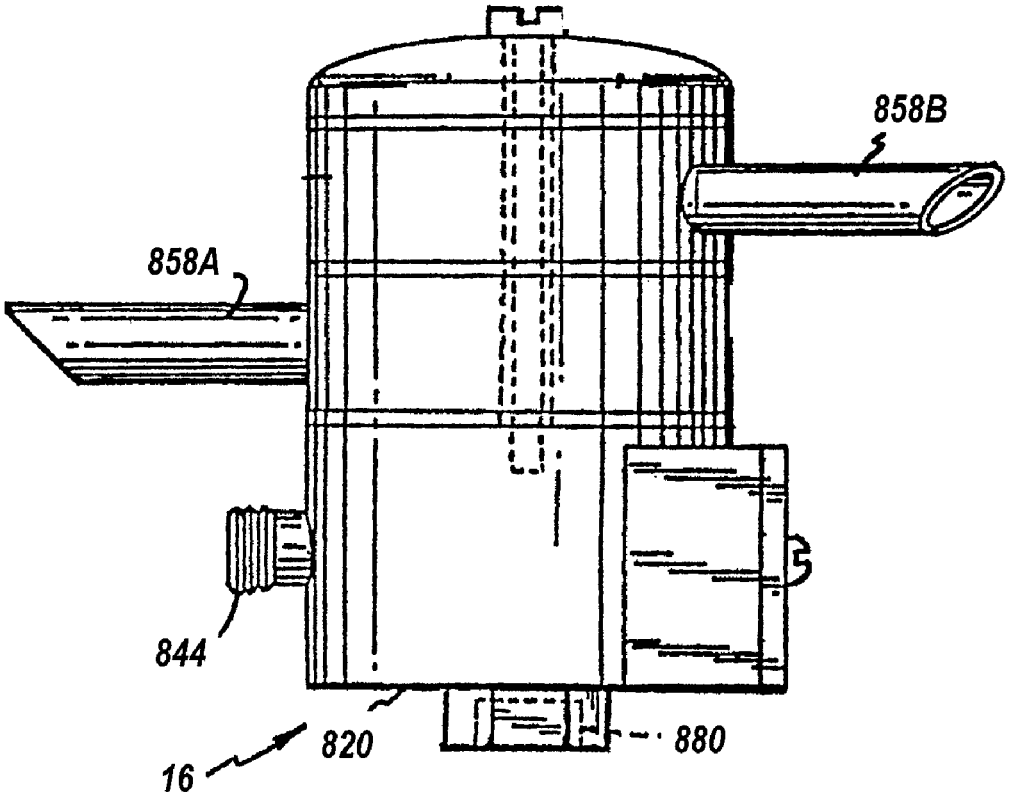
FIG. 8A shows a physical housing for a detector assembly.
Figure 8B:
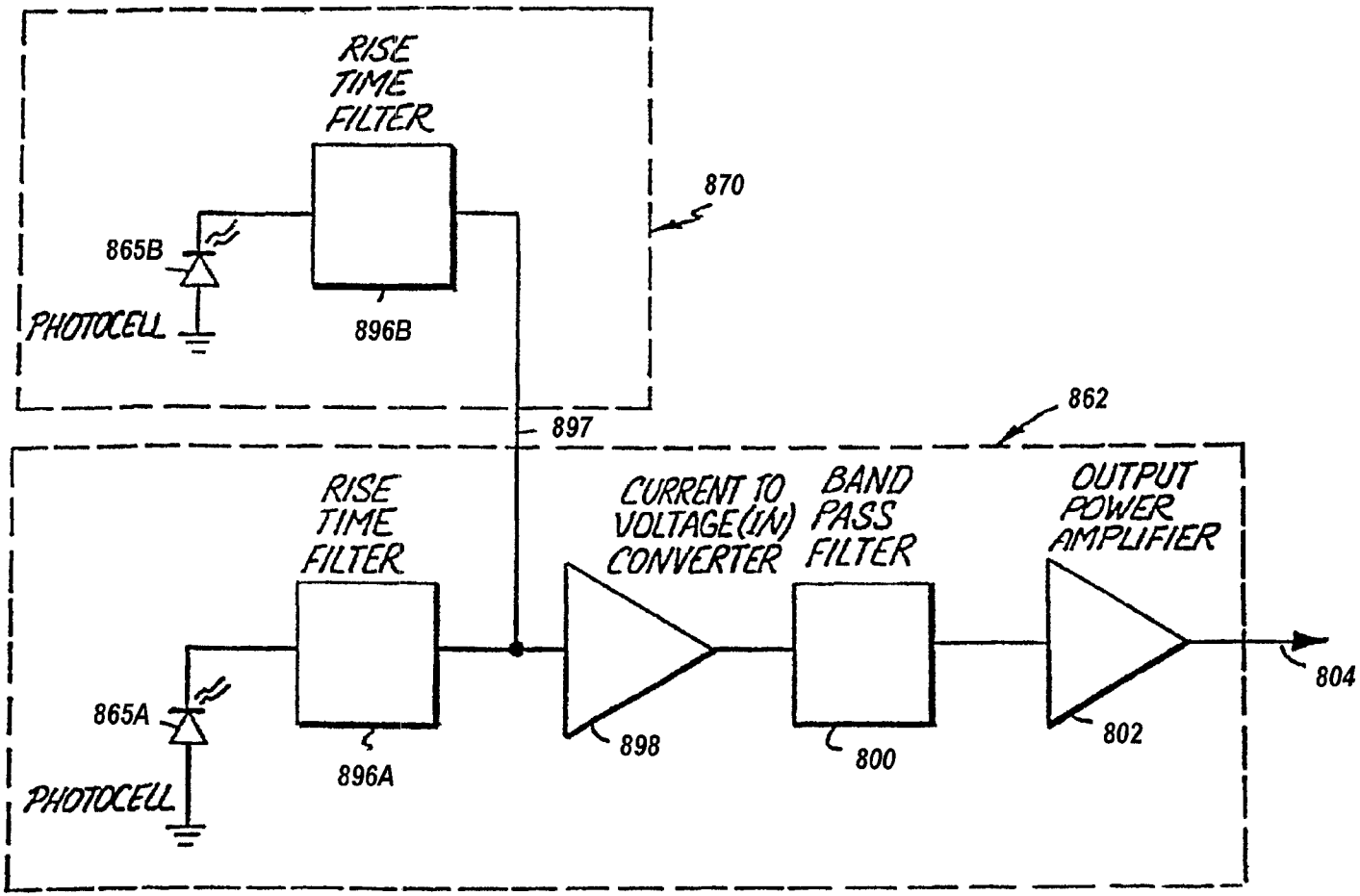
FIG. 8B is a functional block diagram of the circuitry disposed within the detector assembly.

FIG. 8A shows a physical housing for a detector assembly, and FIG. 8B is a functional block diagram of the circuitry disposed within the detector assembly. In FIG. 8A, base unit 820 is a cylindrical shaped housing and serves as a point of attachment for mounting detector assembly 16 near an intersection. Detector assembly 16 can be installed in one of two ways; upright, with base unit 820 at the bottom of detector assembly 16, or inverted, with base unit 20 at the top of detector assembly 16. If detector assembly 16 is installed on a mast arm of a traffic control signal, detector 16 can be installed in either the upright or the inverted position. If detector assembly 16 is mounted to a span wire, detector assembly 16 is typically mounted in the inverted position.

Detector assembly 16 includes tube 858A, which has an opening covered by a window (not shown). A master circuit board (not shown) is positioned within the detector assembly 16, with integrally formed lens and lens tube (not shown) coupled to the master board and extending into tube 858A. Integrally formed lens and lens tube are is positioned in front of a photocell (not shown).

Tube 858A provides a visual indication of the direction in which integrally formed lens and lens tube are aimed. This is helpful to installers and maintainers of detector assembly 16 because they can determine from street level the direction a detector turret is aimed. Cabling for connecting to the phase selector enters base unit 20 through cable entry port 44.

Tube 858B has an integrally formed lens and lens tube (not shown) positioned in front of a second photocell (not shown) which is part of an auxiliary circuit board (not shown) that is coupled to the master board. The auxiliary circuit board sends a signal to the master board in response to the photocell receiving a pulse of light. The master board processes the signal and sends it to phase selector 17 (FIG. 1).

Tubes 858A and 858B (FIG. 7A) have ends which are cut at an angle. Detector assembly 16 is always installed with the tubes positioned such that the shorter side of each tube 858A and 858B is closer to the ground. FIG. 8A shows detector assembly 16 assembled for installation in the upright position. Threaded hole 80 is provided for mounting detector assembly 16 to a traffic signal mast arm or span wire clamp.

FIG. 8B is a block diagram of the circuitry included on fully populated master circuit board 862 and partially populated circuit board 870 as would be disposed in detector assembly 16 of FIG. 7A. The circuitry includes photocells 865A and 865B, rise time filters 896A and 896B, circuit node 897, current-to-voltage (I/V) converter 898, band pass filter 800, output power amplifier 802 and detector channel output 804.

Photocells 865A and 865B receive pulses of light from an emergency vehicle. Rise time filters 896A and 896B allow only quickly changing signals caused by pulses of light to pass. Rise time filters 896A and 896B are high pass filters tuned to a specific frequency, such as 2 KHz.

Each rise time filter 896A and 896B produces an electrical signal having a current that represents a pulse of light received by a photocell. Circuit node 897 sums the currents produced by rise time filters 896A and 896B. Although the embodiment shown in FIG. 8B only has two photocells, circuit node 897 makes it possible to have additional photocells on the same detector channel.

I/V converter 898 converts the current signal summed by circuit node 897 into a voltage signal, which can be processed more conveniently than a current signal. Band pass filter 800 isolates a decaying sinusoid signal from the spectrum of frequencies present in the pulse signal generated by a photocell and a rise time filter in response to a pulse of light. Output power amplifier 802 amplifies the decaying sinusoid signal isolated by band pass filter 800 and provides detector channel output 804 to phase selector 17 of FIG. 1. For each pulse of light received by photocell 865A or 865B, detector channel output 804 produces a number of square wave pulses, wherein the number of square wave pulses varies with the intensity of the light pulse received by the photocell.

Figure 9A:
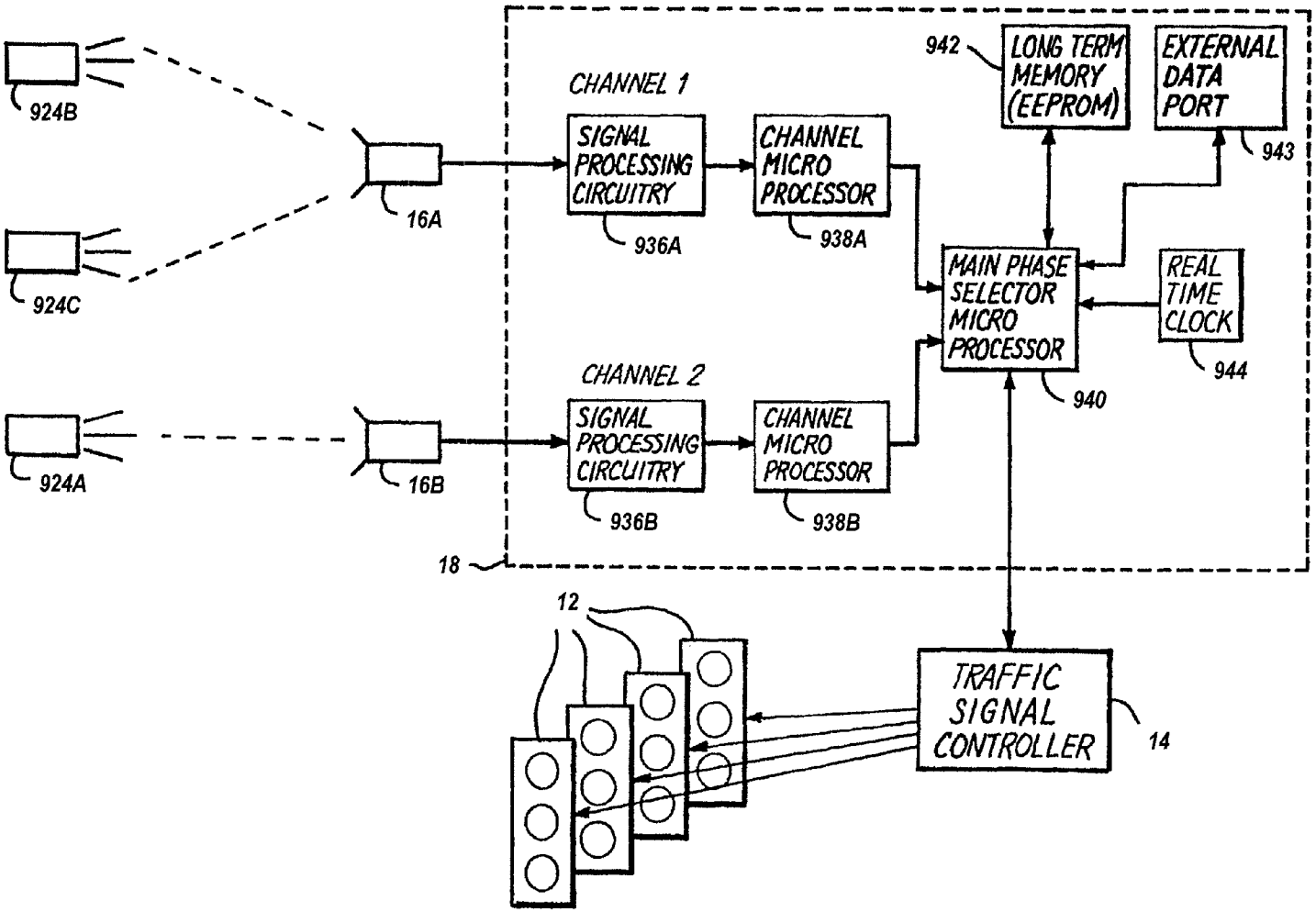
FIG. 9A is a block diagram showing the optical traffic preemption system of FIG. 1.
Figure 9B:
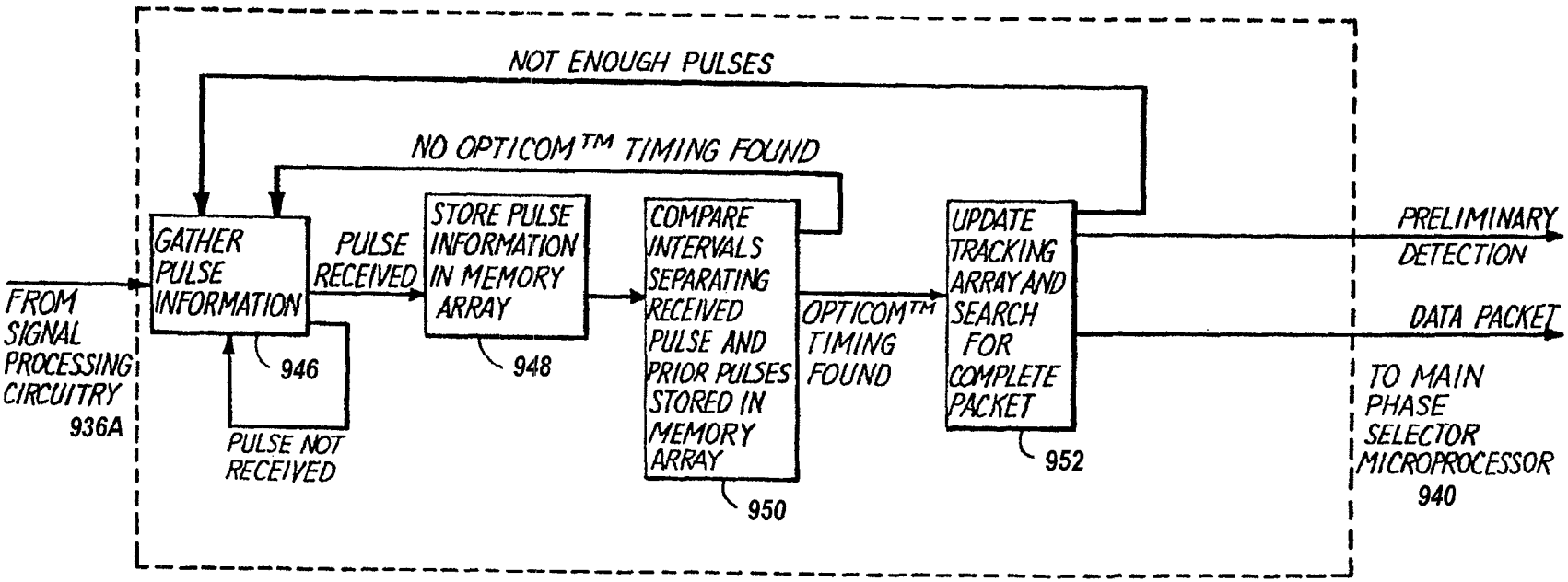
FIG. 9B shows the major components of the algorithm executed by each channel microprocessor.

FIGS. 9A-B are provided for further explanation of the phase detector and overall operation of the traffic control preemption system of FIG. 1. FIG. 9A is a block diagram showing the optical traffic preemption system of FIG. 1. In FIG. 9A, light pulses originating from the optical emitters 924B and 924C are received by the detector assembly 16A, which is connected to a channel one of the phase selector 18. Light pulses originating from the optical emitter 924A are received by the detector assembly 16B, which is connected to a channel two of the phase selector 18.

The phase selector 18 includes the two channels, with each channel having signal processing circuitry (936A and 936B) and a channel microprocessor (938A and 938B), a main phase selector microprocessor 940, long term memory 942, an external data port 943 and a real time clock 944. The main phase selector microprocessor 940 communicates with the traffic signal controller 14, which in turn controls the traffic signal lights 12.

With reference to the channel one, the signal processing circuitry 936A receives an analog signal provided by the detector assembly 16A. The signal processing circuitry 936A processes the analog signal and produces a digital signal which is received by the channel microprocessor 938A. The channel microprocessor 938A extracts data from the digital signal and provides the data to the main phase selector microprocessor 940. Channel two is similarly configured, with the detector assembly 16B coupled to the signal processing circuitry 936B which in turn is coupled to the channel microprocessor 938B.

The long term memory 942 is implemented using electronically erasable programmable read only memory (EEPROM). The long term memory 942 is coupled to the main phase selector microprocessor 940 and is used to store a list of authorized identification codes and to log data.

The external data port 943 is used for coupling the phase selector 18 to a computer. In one embodiment, external data port 943 is an RS232 serial port. Typically, portable computers are used in the field for exchanging data with and configuring a phase selector. Logged data is removed from the phase selector 18 via the external data port 943 and a list of authorized identification codes is stored in the phase selector 18 via the external data port 943. The external data port 943 can also be accessed remotely using a modem, local-area network or other such device.

The real time clock 944 provides the main phase selector microprocessor 940 with the actual time. The real time clock 944 provides time stamps that can be logged to the long term memory 942 and is used for timing other events.

Each detector channel detects and tracks several transmissions simultaneously. In this embodiment, a processing algorithm is executed by each channel microprocessor (936A and 936B in FIG. 9A). The major components of the algorithm, with respect to the channel microprocessor 938A of channel one, are shown as a block diagram in FIG. 9B.

A module 946 gathers pulse information from the digital signal provided by the signal processing circuitry 936A of FIG. 9A. If the module 946 receives pulse information, a module 948 stores a relative time stamp in a memory array. The relative time stamp serves as a record of a received pulse by indicating the time that the pulse was received relative to other received pulses. Whenever the module 948 stores a relative time stamp, a module 950 scans the memory array and compares the time stamp just stored with the time stamps that represent prior received pulses. If a prior received pulse is separated from the pulse just received by a predetermined interval, the pulse information is stored in a tracking array by a module 952.

In an example implementation, a low priority transmission has priority pulses occurring at a repetition rate of 9.639 Hz and a high priority transmission has priority pulses occurring at a repetition rate of 14.035 Hz. In this implementation there are four possible predetermined time intervals separating valid pulses, a first interval of 0.07125 seconds separating sequential high priority pulses, a second interval of 0.03563 seconds separating a high priority pulse from an adjacent high priority data pulse, a third interval of 0.10375 seconds separating sequential low priority pulses and a fourth interval of 0.05187 seconds separating a low priority pulse from an adjacent low priority data pulse.

In other implementations that have more than one data pulse slot between consecutive priority pulses, the predetermined intervals are fractions of the periods of the predetermined repetition rates. In an embodiment that defines a signal format having two data pulse slots spaced evenly between each consecutive pair of priority pulses, there are three predetermined intervals for each repetition rate. A first interval which is the period of the repetition rate, a second interval which is one-third the period of the repetition rate and a third interval which is two-thirds the period of the repetition rate.

The module 952 provides a preliminary detection indication to the main phase selector microprocessor 940 after it initially begins tracking a stream of light pulses originating from a common source. Thereafter, the module 952 provides assembled data packets and continuing detection indications to the main phase selector microprocessor 940. If the module 950 determines that none of the prior pulses are separated from the received pulse by a predetermined interval, control is returned to the module 946.

The present invention is thought to be applicable to a variety of systems for controlling the flow of traffic. Other aspects and embodiments of the present invention will be apparent to those skilled in the art from consideration of the specification and practice of the invention disclosed herein. It is intended that the specification and illustrated embodiments be considered as examples only, with a true scope and spirit of the invention being indicated by the following claims.

We claim:

1. An apparatus for use with a traffic control preemption system that has a receiver with a photodetector and circuitry that produces a number of electrical pulses in response to each detected light pulse, wherein for each detected light pulse the number of electrical pulses represents a level of radiant power of the light pulse, and a threshold number of electrical pulses and an activation frequency at which the threshold number of electrical pulses is repeated activates preemption, comprising:

a light emitter;

control circuitry coupled to the light emitter and controlling the light emitter to emit bursts of light pulses, wherein each burst includes at least two light pulses and a frequency of light pulses in each burst and a frequency of the bursts cause the receiver to produce at least the threshold number of electrical pulses at the activation frequency and activate the preemption.

2. The apparatus according to claim 1, wherein the light emitter device comprises a plurality of LEDs.

3. The apparatus according to claim 2 wherein the LEDs are infrared LEDs.

4. The apparatus of claim 2, wherein the plurality of LEDs include a plurality of visible light LEDs and a plurality of infrared LEDs.

5. The apparatus of claim 2, further comprising a plurality of lenses that disperse the light pulses emitted by the plurality of LEDs.

6. The apparatus of claim 5, wherein lenses in a first subset of the lenses have a first dispersion angle and lenses in a second subset of the lenses have a second dispersion angle that is narrower than the first dispersion angle.

7. The apparatus of claim 2, further comprising a light bar for mounting to a vehicle, and the plurality of LEDs are mounted in the light bar.

8. The apparatus of claim 1, wherein the light emitter device comprises a plurality of gas discharge lamps, and for a first pulse of the burst, the control circuitry triggers at least a first one of the gas discharge lamps, and for a second pulse of the burst, the control circuitry triggers at least a second one of the gas discharge lamps and not the first one of the gas discharge lamps.

9. The apparatus of claim 1, wherein the light emitter device comprises a plurality of halogen lamps, and for a first pulse of the burst, the control circuitry triggers at least a first one of the halogen lamps, and for a second pulse of the burst, the control circuitry triggers at least a second one of the halogen lamps and not the first one of the halogen lamps.

10. The apparatus of claim 1, wherein the light emitter device comprises a plurality of light sources, at least a first one of the light sources is of a first type, at least a second one of the light sources is of a second type that is different from the first type, and for a first pulse of the burst, the control circuitry triggers the first light source, and for a second pulse of the burst the control circuitry triggers the second light source and not the first light source.

11. The apparatus of claim 1, wherein the light emitter device comprises a single gas discharge lamp.

12. The apparatus of claim 1, wherein the light emitter device comprises a single halogen lamp.

13. The apparatus of claim 1, wherein the light emitter and control circuitry are disposed in a hand-held housing.

14. A method for operating a traffic control preemption system that includes a receiver with a photodetector and circuitry that produces a number of electrical pulses in response to each detected light pulse, wherein for each detected light pulse the number of electrical pulses represents a level of radiant power of the light pulse, and a threshold number of electrical pulses and an activation frequency at which the threshold number of electrical pulses is repeated activates preemption, comprising:

activating a light emitter to initiate traffic control preemption;

in response to the activating, triggering emission of a plurality of bursts of light pulses, each burst including two or more light pulses; and controlling a frequency of light pulses in each burst and a frequency of the bursts to cause the receiver circuitry to produce at least the threshold number of electrical pulses at the activation frequency to activate the preemption.

15. The method of claim 14, wherein the triggering emission includes applying power to a plurality of LEDs.

16. The method of claim 15, wherein the plurality of LEDs are infrared LEDs.

17. The method of claim 15, wherein the plurality of LEDs include a plurality of visible light LEDs and a plurality of infrared LEDs.

18. The method of claim 14, wherein the triggering emission includes applying power to a plurality of gas discharge lamps, and for a first pulse of the burst, the triggering at least a first one of the gas discharge lamps, and for a second pulse of the burst, the triggering at least a second one of the gas discharge lamps and not the first one of the gas discharge lamps.

19. The method of claim 14, wherein the triggering emission includes applying power to a plurality of halogen lamps, and for a first pulse of the burst, triggering at least a first one of the halogen lamps, and for a second pulse of the burst, triggering at least a second one of the halogen lamps and not the first one of the halogen lamps.

20. The method of claim 14, wherein the triggering emission includes applying power to at least a first one of a plurality of light sources of a first type for a first pulse of the burst, applying power to at least a second one of a plurality of light sources of a second type for a second pulse of the burst without applying power to the first light source, wherein the second type of light source is different from the first type of light source.

21. The method of claim 14, wherein the triggering emission includes applying power to a single gas discharge lamp.

22. The method of claim 14, wherein the triggering emission includes applying power to a single halogen lamp.

23. A light emitter for activating preemption in a traffic control preemption system that has a receiver with a photodetector and circuitry that produces a number of electrical pulses in response to each detected light pulse, wherein for each detected light pulse the number of electrical pulses represents a level of radiant power of the light pulse, and a threshold number of electrical pulses and an activation frequency at which the threshold number of electrical pulses is repeated activates preemption, comprising:

a power supply;

a plurality of LEDs coupled to the power supply;

a switch coupled to the plurality of LEDs for controllably switching power on and off to the plurality of LEDs;

a microcontroller coupled to the power supply and to the switch, wherein the microcontroller is configured to control the switch for powering on and off the plurality of LEDs to emit bursts of light pulses to activate the preemption, wherein each burst includes at least two pulses and the microcontroller controls a frequency of the light pulses in each burst and a frequency of the bursts to cause the receiver to produce at least the threshold number of electrical pulses at the activation frequency for activating the preemption.

24. The light emitter of claim 23, wherein the plurality of LEDs comprises a plurality of channels of LEDs, each channel being powered separate from the other channels.

25. The light emitter of claim 24, wherein each channel includes a respective capacitor coupled between the power supply and the LEDs in the channel and a respective voltage controlled current source that is coupled to the LEDs in the channel, switch, and microcontroller, wherein the microcontroller is configured to adjust current in one or more of the LED channels in response to a lack of current level in one of the channels of LEDs.

26. The light emitter of claim 23, further comprising a temperature sensor coupled to the microcontroller, wherein the microcontroller is configured to adjust pulse amplitude and pulse width via the trigger in response to a temperature indicated by the temperature sensor.

27. The apparatus of claim 23, further comprising a handheld housing, wherein the power supply, plurality of LEDs, switch, and microcontroller are disposed in the housing.

* * * * *